United States Patent [19]

Schlick et al.

[11] Patent Number: 4,913,705

[45] Date of Patent: Apr. 3, 1990

[54] DYEING A MIXED FIBRE FABRIC OF CELLULOSE/POLYACRYLONITRILE OF CELLULOSE/ACID-MODIFIED POLYESTER WITH A REACTIVE DYE AND A BASIC DYE

[75] Inventors: Bernhard Schlick, Basel, Switzerland; Claudio Artico, Udine, Italy

[73] Assignee: Sandoz Ltd., Basel, Switzerland

[21] Appl. No.: 240,035

[22] Filed: Sep. 2, 1988

[30] Foreign Application Priority Data

Sep. 5, 1987 [DE] Fed. Rep. of Germany ..... 3729769

[51] Int. Cl.[4] ..... D06P 3/82; C09B 67/00

[52] U.S. Cl. ..... 8/532; 8/496; 8/534; 8/539; 8/541; 8/543; 8/551; 8/556; 8/654; 8/657; 8/918; 8/922; 8/927

[58] Field of Search ..... 8/532, 534, 539, 556

[56] References Cited

U.S. PATENT DOCUMENTS

| | | | |
|---|---|---|---|
| 3,852,261 | 12/1974 | Steinemann | 8/655 |
| 4,410,652 | 10/1983 | Robinson et al. | 8/496 |
| 4,436,524 | 3/1984 | Valenti | 8/551 |
| 4,439,203 | 3/1984 | Runyon et al. | 8/496 |
| 4,439,208 | 3/1984 | Moser et al. | 8/556 |
| 4,443,223 | 4/1984 | Kissling et al. | 8/496 |
| 4,452,606 | 6/1984 | van Diest et al. | 8/496 |
| 4,511,707 | 4/1985 | Runyon et al. | 8/496 |
| 4,764,585 | 8/1988 | Heller et al. | 8/536 |

FOREIGN PATENT DOCUMENTS

| | | |
|---|---|---|
| 151370 | 8/1985 | European Pat. Off. . |
| 2138030 | 10/1984 | United Kingdom . |

*Primary Examiner*—A. Lionel Clingman

*Attorney, Agent, or Firm*—Gerald D. Sharkin; Richard E. Vila; Thomas C. Doyle

[57] ABSTRACT

A mixed fabric of hydroxy group-containing fibers and cyano and/or carboxy group-containing fibers, the hydroxy group-containing fibers having been dyed with a reactive dye, is aftertreated with a product of reacting a mono- or polyfunctional amine having one or more primary, secondary and/or tertiary amino groups with cyanamide, dicyandiamide guanidine or bis-guanidine, said product containing at least one reactive hydrogen atom linked to a nitrogen atom, and is then dyed with a basic dye.

20 Claims, No Drawings

DYEING A MIXED FIBRE FABRIC OF CELLULOSE/POLYACRYLONITRILE OF CELLULOSE/ACID-MODIFIED POLYESTER WITH A REACTIVE DYE AND A BASIC DYE

According to the invention, there is provided a process for dyeing a mixed fibre fabric of hydroxy-group-containing and cyano- and/or carboxy-group-containing fibres characterised by (a) aftertreating the hydroxy-group-containing fibres of the fabric, which fibres have been dyed with a reactive dye, with a polymeric reaction product A (herein defined as Product A), product A being the product of reacting a mono- or poly-functional amine having one or more primary and/or secondary and/or tertiary amino groups with cyanamide, dicyandiamide, guanidine or bisguanidine (in which up to 50 mole percent of the cyanamide, di-cyandiamide, guanidine or bisguanidine may be replaced by a dicarboxylic acid or mono- or di-ester thereof) whereby ammonia splits off (optionally in the presence of a catalyst); said product A containing at least one free hydrogen atom linked to a nitrogen atom; and (b) dyeing the fabric, following aftertreatment with Product A, with a basic dyestuff.

Preferably the hydroxy-group-containing fibres are cellulose (e.g. cotton) and the cyano- and/or carboxy-group containing fibres are polyacrylonitrile or acid modified polyester fibres.

Preferably the mixed fibre fabric is cotton/polyacrylonitrile or cotton/acid modified polyester.

Product A is known and is described, together with methods for preparation, e.g. in U.S. Pat. No. 4,410,652 and U.S. Pat. No. 4,764,585 (=GB Patent Application 2,163,760 A); the contents and preferences of the said U.S. patents are incorporated herein by reference.

The catalysts that can be used for the production of Product A are those defined as catalyst K in U.S. Pat. No. 4,764,585 and GB Patent Application 2,163,760 A, the description of which is incorporated herein by reference from these patent specifications.

The reactive dyes that can be used to dye the hydroxy-group-containing fibres in a process according to the invention are preferably those defined as Reactive Dyes in the Colour Index, more preferably those reactive dyes defined in U.S. Pat. No. 4,764,585.

The basic dyes that can be used to dye the cyano- and/or carboxy group-containing fibres are preferably those defined in the Colour Index as Basic Dyes, more preferably those Basic dyes defined in U.S. Pat. No. 3,852,261.

The hydroxy-group-containing fibres are dyed by immersing the fabric in a first dyeing bath containing the reactive dye or dyes and dyeing is carried out at elevated temperatures (e.g. 70°-80° C.) and then cold washed.

The fabric is then preferably immersed in a second bath containing the aftertreatment Product A according to known methods (for example as given in the dyeing examples of U.S. Pat. No. 4,764,585). Aftertreatment is preferably carried out at 20°-70° C., more preferably 60° C.

Dyeing of the cyano- and/or carboxy-group-containing fibres is carried out in a third bath containing basic dyes by known methods, for example according to U.S. Pat. No. 3,852,261, the content of which is incorporated herein by reference.

The present invention alleviates the problem that reactive dyes on the cotton fibres of a mixed fabric of cotton/polyacrylonitrile tend (with the exception of a select number of reactive dyes) to have a staining effect on the polyacrylonitrile and that there is a strong smudging effect of the basic dyes on the cellulose part of the mixed fibre fabric.

The dyeings so produced have good fastness properties and are level dyeings. The present invention also alleviates the time consuming soaping needed to remove the unbound reactive dye resulting from dyeing.

The invention will now be illustrated by the following Examples in which all parts and percentages are by weight, all temperatures are in °C. and all percentages are based on the weight of substrate unless indicated to the contrary.

EXAMPLE 1

100 Parts of a 50:50 mixed fibre fabric of cotton/polyacrylonitrile are dyed from an aqueous exhaust bath with 0.18% C.I. Reactive Yellow 58, 0.12% C.I. Reactive Yellow 29 and 2.2% C.I. Reactive Blue 18 conventionally.

The fabric that has been dyed with the reactive dyes (only the cotton part is dyed) is then treated in an aftertreatment bath containing 2% of the compound of Example 1 of GB Published Patent Application No. 2,163,760 A (=U.S. Pat. No. 4,764,585).

The fabric is then washed for 2 minutes and is then dyed in a further aqueous bath containing 0.05% of the dyestuff of formula 1a

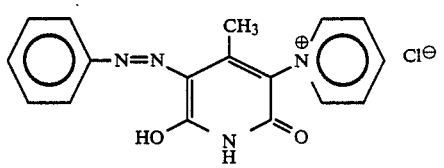

(1a)

0.02% of C.I. Basic Yellow 82; and
0.12% of the compound of formula 1b

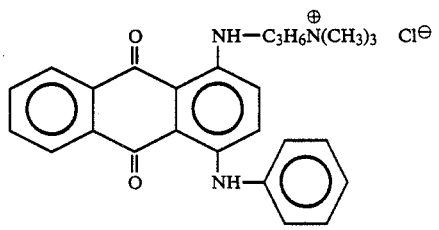

(1b)

This produces a fabric having a level dyeing and good wet fastness properties.

EXAMPLE 2

A mixed fibre fabric (50:50 cotton/polyacrylonitrile) as in Example 1 is dyed with 1.1% C.I. Reactive Yellow 41, 1.6% C.I. Reactive Red 56 and 0.41% C.I. Reactive Blue 17.

The dyed fabric is then treated with the aftertreatment product of Example 1 according to Example 1.

The treated fabric is then dyed with 0.21% C.I. Basic Yellow 82, 0.14% of the dyestuff of formula 2a

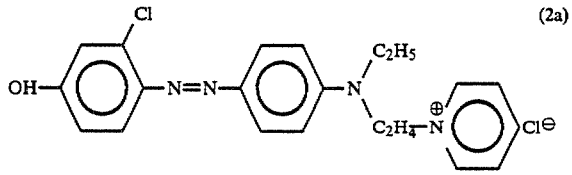

(2a)

and 0.046% of the dyestuff of formula 2b

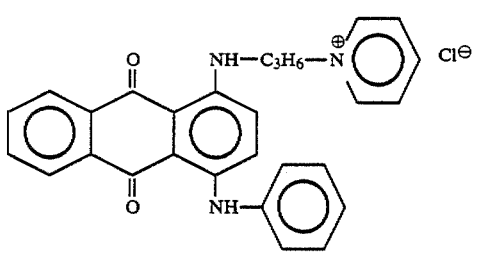

(2b)

This produces a fabric having a level dyeing with good wet-fastness properties.

EXAMPLES 3 TO 15

100 Parts of a mixed fibre fabric (50:50 cotton/polyacrylonitrile) is dyed using reactive dyes as listed in Table 1 below by immersing the fabric in an aqueous exhaust bath (Bath 1) conventionally, thereby dyeing the cotton.

The dyed fabric is then immersed in an aqueous bath containing 2% of the Aftertreatment Agent of Example 1 (i.e. the compound of Example 1 of GB Published Patent Application 2,163,760 A). The treated fabric is then washed for 2 minutes.

The fabric is then immersed in a third aqueous dyebath (Bath 3) containing the Basic dyes as given in the Table below. Level, wet fast dyeings result.

TABLE

| Example | Reactive Dyes of Bath 1 | Basic Dyes of of Bath 3 | Colour of Dyeing |
|---|---|---|---|
| 3. | 2% CI Reactive Yellow 125 | 0,35% CI Basic Yellow 82 | Gold Yellow |
| 4. | 1% CI Reactive Orange 64 | 0,17% CI Basic Yellow 82 | Brillant Red |
| | 1,1% CI Reactive red 159 | 0,75% CI Basic Red 104 | |
| 5. | 0,31 CI Reactive Orange 69 | 0,12% CI Basic Yellow 82 | Navy blue |
| | 0,85% CI Reactive Red 159 | 0,09% CI Basic Red 104 | |
| | 1,4% CI Reactive Blue 193 | 0,3% CI Basic Blue 41:1 | |
| 6. | 0,09% CI Reactive Red 147 | 0,005% CI Basic Yellow 82 | Blue |
| | 2% CI Reactive Blue 114 | 0,012% CI Basic Red 104 | |
| | | 0,2% CI Basic Blue 41:1 | |
| 7. | 2,5% CI Reactive Blue 41 | 0,175% CI Basic Blue 3 | Turquoise |
| 8. | 2,25% CI Reactive Blue 41 | 0,08% CI Basic Yellow 13 | |
| | 1,25% CI Reactive Green 12 | 0,022% CI Basic Blue 41:1 | Brillant Green |
| | | 0,14% CI Basic Blue 3 | |
| 9. | 1,75% CI Reactive Orange 11 | 0,25% CI Basic Yellow 82 | Brown |
| | 0,95% CI Reactive Red 55 | 0,1% CI Basic Red 104 | |

TABLE-continued

| Example | Reactive Dyes of Bath 1 | Basic Dyes of of Bath 3 | Colour of Dyeing |
|---|---|---|---|
| | 0,2% CI Reactive Blue 52 | 0,034% CI Basic Blue 41:1 | |
| 10. | 2,3% CI Reactive Green 15 | 0,08% CI Basic Yellow 82 | Green |
| | | 0,12% CI Basic Blue 41:1 | |
| 11. | 0,5% CI Reactive Orange 11 | 0,1% CI Basic Yellow 82 | Anthracite |
| | 0,43% CI Reactive Red 55 | 0,05% CI Basic Red 104 | |
| | 1% CI Reactive Blue 214 | 0,15% CI Basic Blue 41:1 | |
| 12. | 1,2% Reactive Orange 74 | 0,15% CI Basic Yellow 82 | Golden Yellow |
| 13. | 1,4% Reactive Orange 91 | 0,4% CI Basic Yellow 28 (48'054) | Brown |
| | 0,4% Reactive Red 184 | 0,18% CI Basic Red 46 | |
| | 0,25% Reactive Blue 182 | 0,11% CI Basic Blue 41(11'105) | |
| 14. | as in Example 13 | 0,78% CI Basic Yellow 77 | Brown |
| | | 0,28% CI Basic Red 51 | |
| | | 0,08% CI Basic Blue 124 | |
| 15. | 0,6% CI Reactive Orange 14 (19'138) | 0,15% CI Basic Yellow 82 | Yellowish Orange |

What is claimed is:

1. A process for dyeing a mixed fibre fabric of hydroxy-group-containing and cyano- and/or carboxy-group-containing fibres characterised by (a) aftertreating the hydroxy-group-containing fibres of the fabric, which fibres have been dyed with a reactive dye, with a polymeric Product A which is the product of reacting a mono- or poly-functional amine having one or more primary and/or secondary and/or tertiary amino groups with cyanamide, dicyandiamide, guanidine or bisguanidine (in which up to 50 mole percent of the cyanamide, di-cyandiamide, guanidine or bisguanidine may be replaced by a dicarboxylic acid or mono- or di-ester thereof) whereby ammonia splits off, said Product A containing at least one free hydrogen atom linked to a nitrogen atom; and (b) dyeing the fabric, following aftertreatment with Product A, with a basic dyestuff.

2. A process according to claim 1, in which the mixed fibre fabric is cellulose/polyacrylonitrile or cellulose/acid modified polyester.

3. A process according to claim 2, in which the mixed fibre fabric is cotton/polyacrylonitrile.

4. A process according to claim 1, in which the aftertreatment is carried out at a temperature of from 20° to 70° C. inclusive.

5. A process according to claim 1 comprising:

(a) dyeing the hydroxy-group containing fibres of the fabric with a reactive dye in a first bath;

(b) aftertreating the hydroxy-group-containing fibres of the fabric with polymeric reaction Product A defined in claim 1 in a second bath; and (c) dyeing the fabric, following aftertreatment with Product A with a basic dyestuff in a third bath.

6. A process according to claim 1 wherein Product A is a product of reacting an amine of formula I or II $$R—NH—R \quad (I)$$

$$RRN—(Z—X)_n—Z—NR \quad (II)$$

in which each R, independently, is hydrogen or a $C_{1-10}$alkyl group unsubstituted or monosubstituted by hydroxy, $C_{1-4}$alkoxy or cyano, n is a number from 0 to 100, Z, or each Z independently when $n>0$, is $C_{2-4}$alkylene or hydroxyalkylene and X, or each X independently when $n>1$, is —O—, —S— or —NR— where R is as defined above, provided that the amine of formula II contains at least one reactive —NH— or $NH_2$ group, with cyanamide, dicyandiamide or guanidine in a mol ratio of 0.1 to 1 mol of cyanamide, dicyandiamide or guanidine per mol of reactive —NH— or —$NH_2$ groups.

7. A process according to claim 5 wherein Product A is a product of reacting an amine of formula I or II $$R—NH—R \quad (I)$$

$$RRN—(Z—X)_n—Z—NRR \quad (II)$$

in which each R, independently, is hydrogen or a $C_{1-10}$alkyl group unsubstituted or monosubstituted by hydroxy, $C_{1-4}$alkoxy or cyano, n is a number from 0 to 100, Z, or each Z independently when $n>0$, is $C_{2-24}$alkylene or hydroxyalkylene and X, or each X independently when $n>1$, is —O—, —S— or —NR— where R is as defined above, provided that the amine of formula II contains at least one reactive —NH— or $NH_2$ group, with cyanamide, dicyandiamide or guanidine in a mol ratio of 0.1 to 1 mol of cyanamide, dicyandiamide or guanidine per mol of reactive —NH— or —$NH_2$ groups.

8. A process according to claim 6 wherein Product A is a product of reacting diethylene triamine or triethylene tetramine with dicyandiamide.

9. A process according to claim 7 wherein Product A is a product of reacting diethylene triamine or triethylene tetramine with dicyandiamide.

10. A process according to claim 1 wherein Product A is produced by reacting the amine with cyanamide, dicyandiamide, guanidine or bis-guanidine in the presence of a catalyst selected from metals of Group II or III of the periodic table, salts of said metals and pyridines substituted by a tertiary amino group.

11. A process according to claim 5 wherein Product A is produced by reacting the amine with cyanamide, dicyandiamide, guanidine or bis-guanidine in the presence of a catalyst selected from metals of Group II or III of the periodic table, salts of said metals and pyridines substituted by a tertiary amino group.

12. A process according to claim 6 wherein Product A is a product of reacting the amine with cyanamide, dicyandiamide or guanidine in the presence of a catalyst selected from metals of Group II or III of the periodic table, salts of said metals and pyridines substituted by a tertiary amino group.

13. A process according to claim 7 wherein Product A is a product of reacting the amine with cyanamide, dicyandiamide or guanidine in the presence of a catalyst selected from metals of Group II or III of the periodic table, salts of said metals and pyridines substituted by a tertiary amino group.

14. A process according to claim 9 wherein Product A is a product of reacting diethylene triamine or triethylene tetramine with dicyandiamide in the presence of 0.01 to 10% by weight zinc chloride based on the total weight of the amine and dicyandiamide.

15. A process according to claim 6 wherein the fabric is cellulose/polyacrylonitrile or cellulose/acid modified polyester and the aftertreatment is carried out at a temperature of 20° to 70° inclusive.

16. A process according to claim 7 wherein the fabric is cellulose/polyacrylonitrile or cellulose/acid modified polyester and the aftertreatment is carried out at a temperature of 20° to 70° inclusive.

17. A process according to claim 12 wherein the fabric is cellulose/polyacrylonitrile or cellulose/acid modified polyester and the aftertreatment is carried out at a temperature of 20° to 70° inclusive.

18. A process according to claim 14 wherein the fabric is cellulose/polyacrylonitrile or cellulose/acid modified polyester and the aftertreatment is carried out at a temperature of 20° to 70° inclusive.

19. A mixed fiber fabric dyed by the process of claim 7.

20. A dyed fabric produced by the process of claim 17.

* * * * *